US006045131A

United States Patent [19]

Adams et al.

[11] Patent Number: 6,045,131

[45] Date of Patent: Apr. 4, 2000

[54] METHOD OF PLAYING A CARD GAME

[76] Inventors: Darius Adams; Donald Miller, both of 69-03 242nd St. #1, Douglaston, N.Y. 11362

[21] Appl. No.: 09/175,529

[22] Filed: Oct. 20, 1998

[51] Int. Cl.[7] ..... A63F 1/00

[52] U.S. Cl. ..... 273/296; 273/292; 273/430

[58] Field of Search ..... 273/296, 292, 273/430, 431, 432, 429, 302, 308

[56] References Cited

U.S. PATENT DOCUMENTS

| | | | |
|---|---|---|---|
| 1,314,522 | 9/1919 | Knoos, Jr. | 273/292 |
| 4,124,214 | 11/1978 | Pavis | 273/249 |
| 4,201,388 | 5/1980 | Cantelon | 273/251 |
| 5,141,235 | 8/1992 | Hernandez | 273/308 |
| 5,186,467 | 2/1993 | Chasin | 273/298 |
| 5,205,563 | 4/1993 | Dearing | 273/296 |
| 5,607,160 | 3/1997 | Stevens | 273/249 |
| 5,690,336 | 11/1997 | Oliver | 273/302 |

*Primary Examiner*—Benjamin H. Layno
*Attorney, Agent, or Firm*—Goldstein & Canino

[57] ABSTRACT

Playing the game of truth or dare with a deck of predesigned playing cards. The playing cards have a front side with a unique numeral indicia and a rear side with a pair comprising questions and dares and a pair of call numerals adjacent to each question. The game comprises the steps of dealing the playing cards to a plurality of players, asking the questions on the playing cards by the players, responding to the question by the players with playing cards that have the numeral indicia which matches the call numeral of the question asked, and the responding player asking a question from his playing cards.

4 Claims, 5 Drawing Sheets

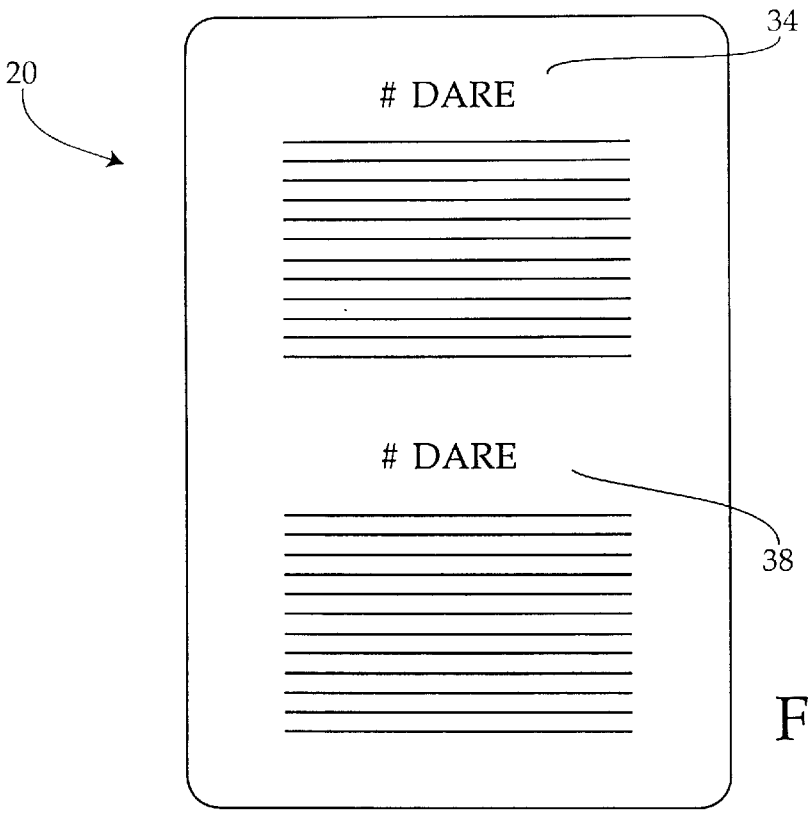
FIG.2D
FIG.3
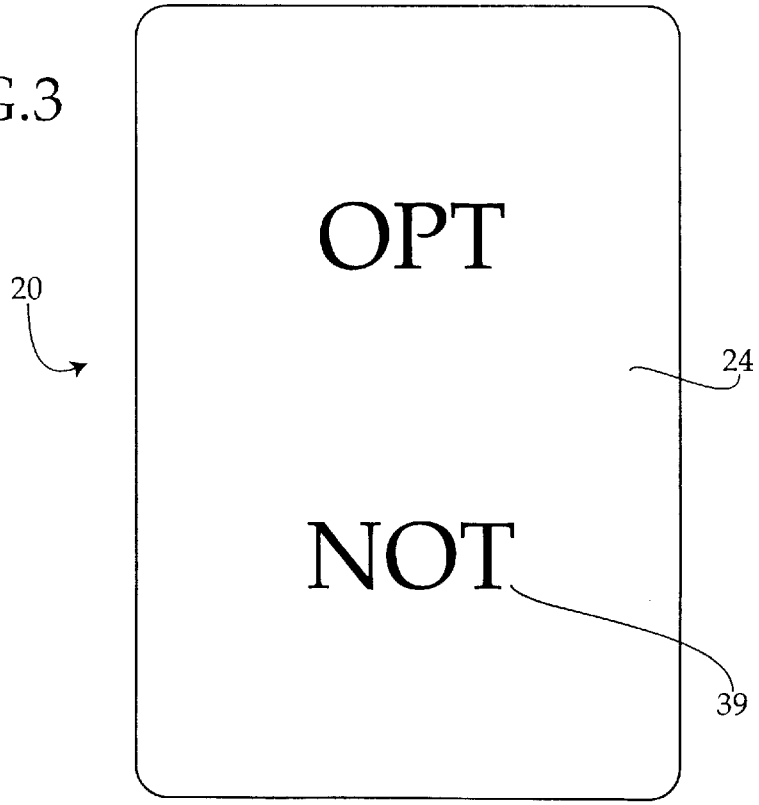

METHOD OF PLAYING A CARD GAME

BACKGROUND OF THE INVENTION

The present invention relates to a card game, and more particularly, to a card game that features personal life questions or trivia questions.

Increasingly, "truth or dare" type party games are becoming very popular with adult audiences. These games allow adults the opportunity to pry into each other's private lives in an enjoyable and playful manner. Adults ask each other questions that solicit potentially embarrassing answers, without being mean-spirited with each other. Usually, the person questioned must answer truthfully, or else bear the dire consequences of being required to do an act chosen by another.

Unfortunately, these games do not have any set rules or formats, and players are forced to modify the game to adopt to the likes and dislikes of other players. Having to play a game that does not have any set rules or format can be very annoying for some.

Truth or dare type games are extremely popular at drinking parties, because they allow audiences to engage each other in doing something fun in addition to merely consuming alcohol and getting drunk. However, as the party progresses and alcohol continues to be consumed, everyone's ability to formulate intelligent questions diminishes. As a result, there is a need for a game device that may be used for truth or dare type party games.

Just as truth or dare games are popular with adult audiences, trivia question games are popular with children. Starting in the 1950s, a variety of games that require a player to correctly answer a question of some type have become increasingly popular. The board game TRIVIAL PURSUIT is a well known example of such a trivia game that requires players to correctly answer questions. These games generally create the excitement of a trivia-type game, while educating the players.

Most of these board games, however, suffer from a variety of drawbacks. First, these board games are bulky and awkward to carry around. As a result, children rarely take these trivia games with them when they travel or go on vacations. Additionally, these board games are disadvantageous in that the game board is always in plain sight so that players see the board and are able to anticipate questions asked, which reduces the surprise effect of having to answer an unanticipated question.

To alleviate the drawbacks of board games, some have proposed using playing cards instead of a game board. However, many of these card games require additional apparatus, such as maps, pictures or the like. As a result, the necessity of having to use additional apparatus makes it inconvenient to carry these playing cards when one is traveling or on vacation.

While these units mentioned above may be suitable for the particular purpose employed, or for general use, they would not be as suitable for the purposes of the present invention as disclosed hereafter.

SUMMARY OF THE INVENTION

It is an object of the present invention to provide a card game that allows people to play truth or dare. Accordingly, playing cards are provided that allows players to quiz each other about their personal lives and life perspectives.

It is another object of the present invention to provide a card game that allows players to play trivia on a variety of topics, such as sports, history, entertainment, geography, etc.

It is yet another object of the present invention to provide a card game that is compact and easy to carry.

It is a further object of the present invention to provide a card game that is fun to play and is capable of lasting for hours. Accordingly, a card game is provided that allows the players to combine a plurality of decks of playing cards with different questions.

To accomplish the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 2D is a bottom plan view of yet another embodiment of the playing card of the present invention.

FIG. 3 is a bottom plan view of another playing card in accordance with the present invention.

DETAILED DESCRIPTION OF THE PREFERRED EMBODIMENTS

Figure 1:
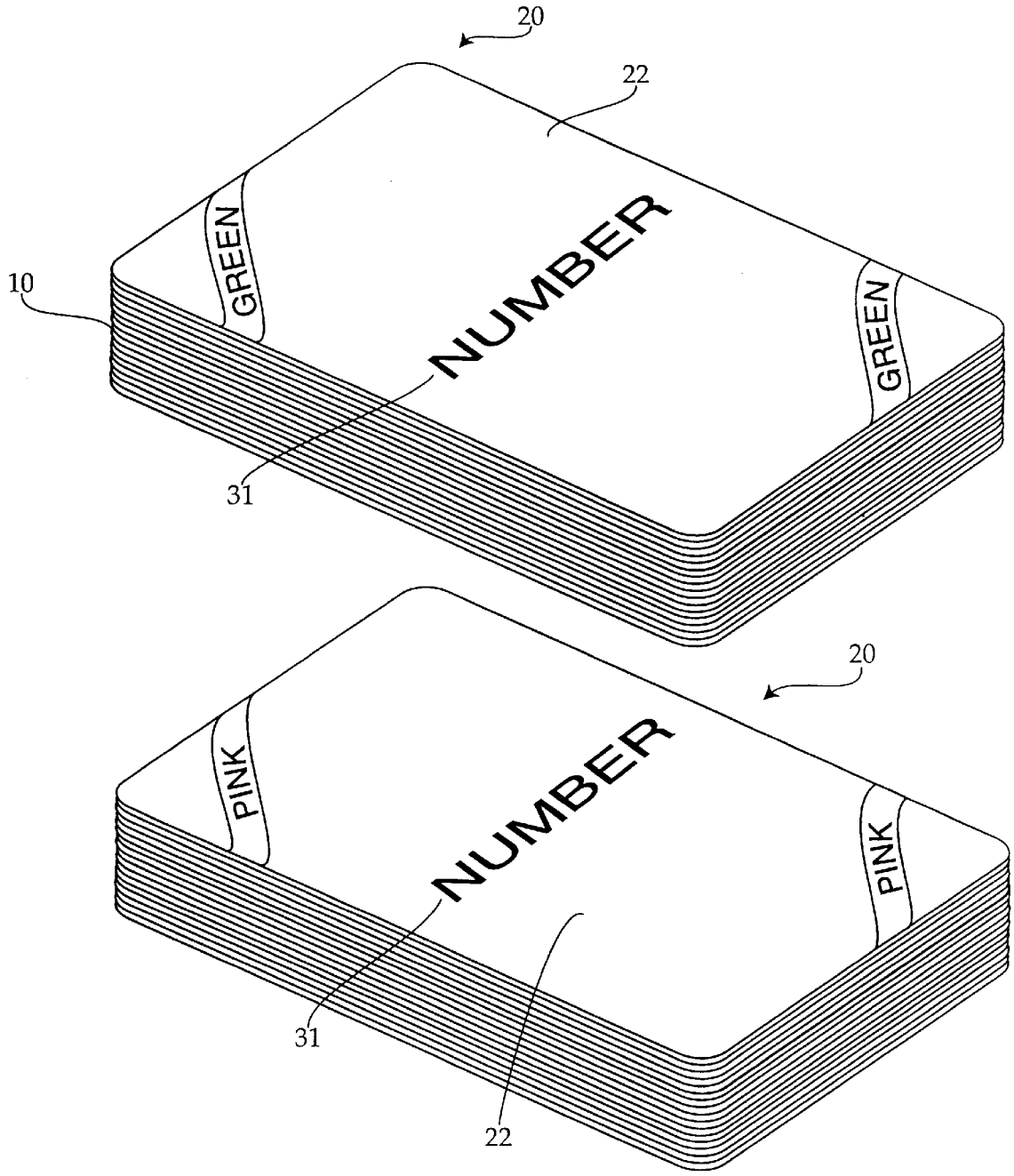
FIG. 1 is a diagrammatic perspective view of a stack of the playing cards in accordance with the present invention.
Figure 2A:
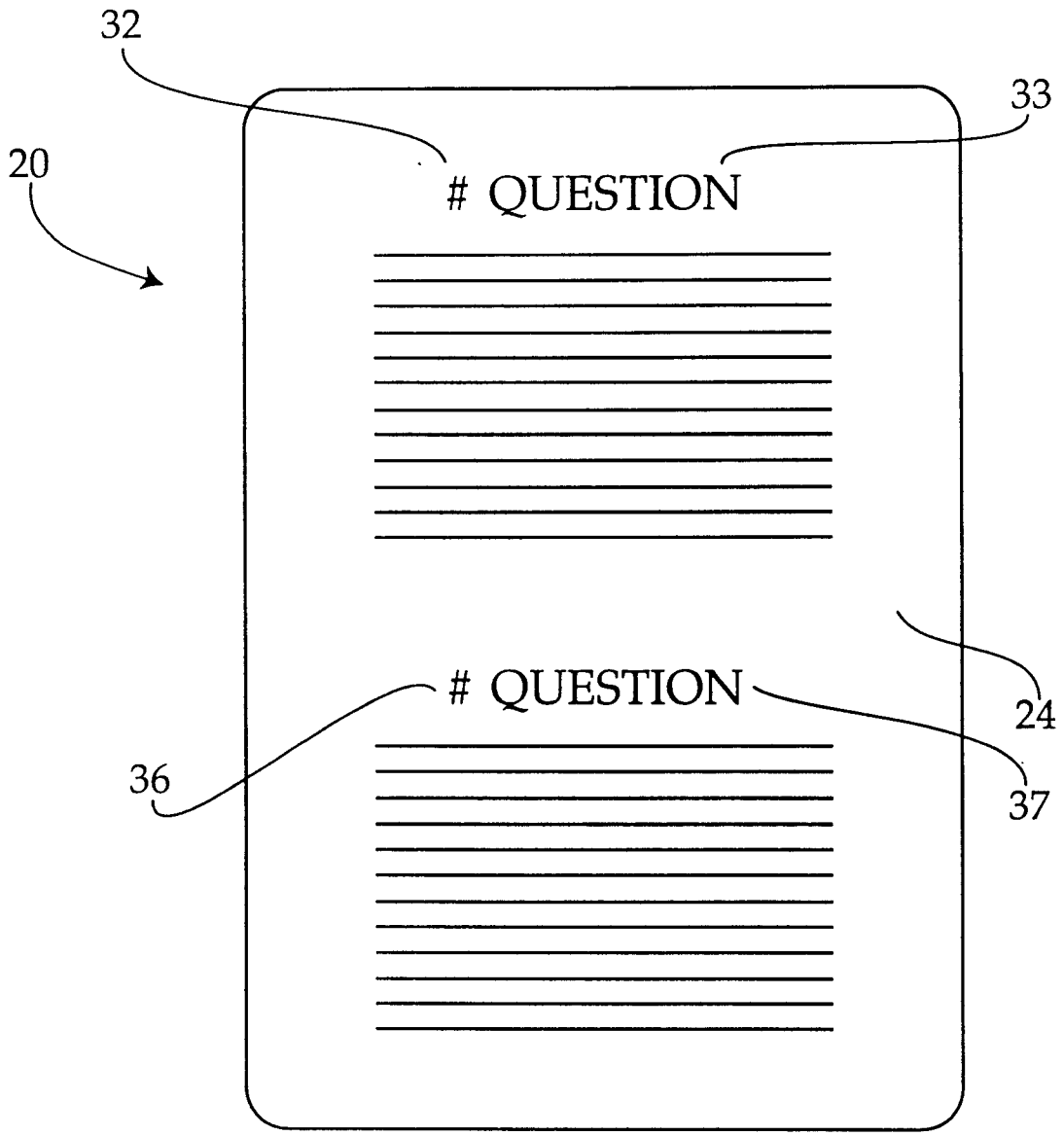
FIG. 2A is a bottom plan view of a playing card in accordance with the present invention.
Figure 2B:
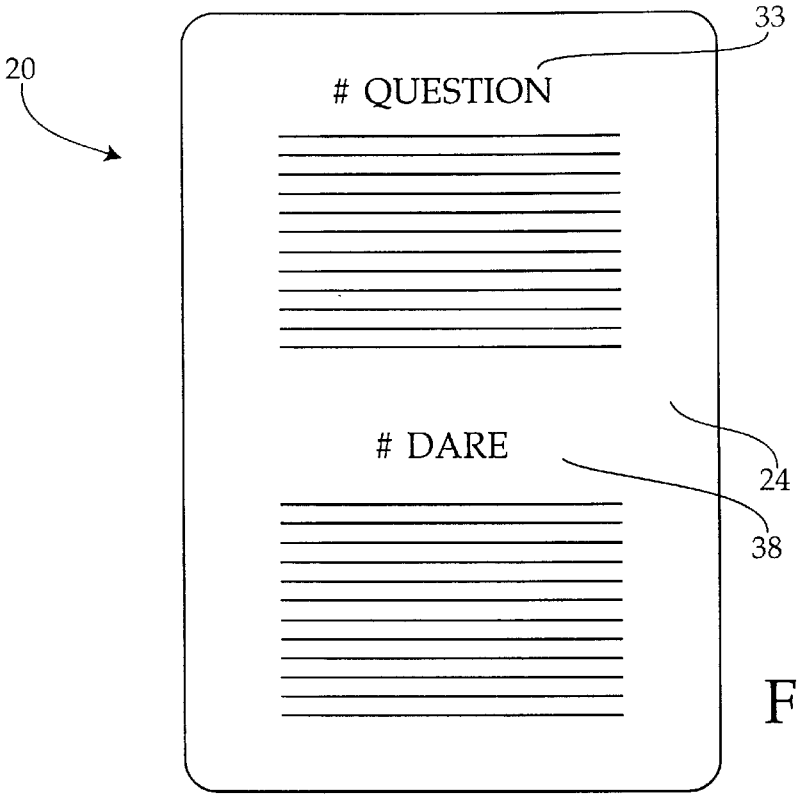
FIG. 2B is a bottom plan view of another embodiment of the playing card in accordance with the present invention.
Figure 2C:
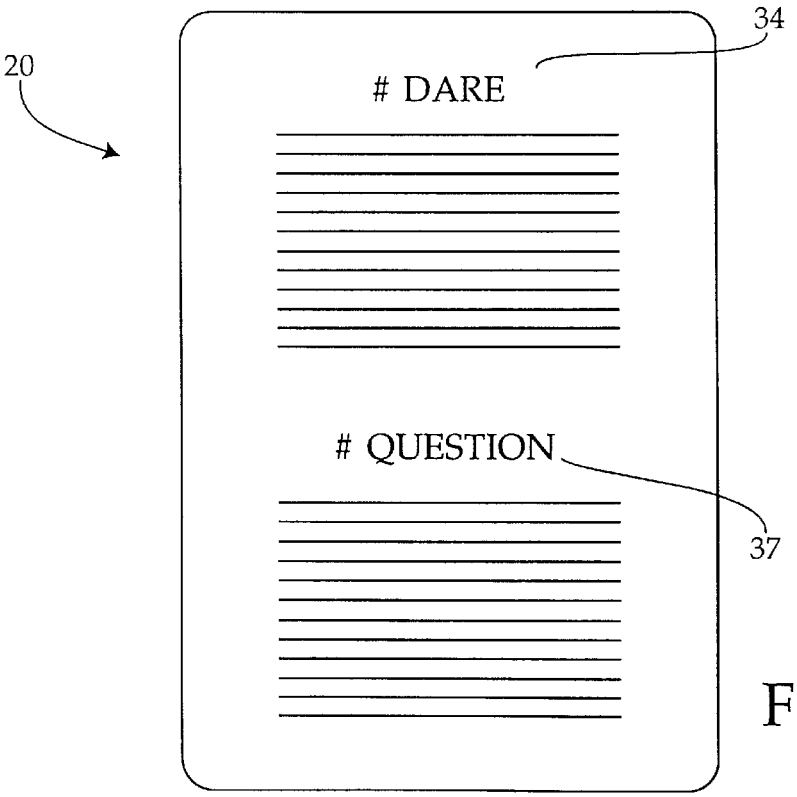
FIG. 2C is a bottom plan view of another embodiment of the playing card in accordance with the present invention.

Referring initially to FIGS. 1–3, the present invention refers to a deck 10 which consists of a plurality of playing cards 20 for playing truth or dare. Each playing card 20 has a front side 22 and a rear side 24.

As shown in FIG. 1, the front side 22 of playing card 20 has a clearly visible numeral indicia 31 that identifiably distinguishes one card 20 from the other. To the playing card 20 from each other, the numeral indicia 31 on each card 20 is unique.

As shown in FIG. 2A–2D, the rear side 24 of each playing card 20 has a top question 33 or a top dare 34 printed adjacent to a top call numeral 32, and a bottom question 37 or a bottom dare 38 printed adjacent to a bottom call numeral 36. Thus, the playing card 20 may either have a top question 33 and a bottom question 37 or a top question 33 and a bottom dare 38 or a top dare 34 and bottom question 37 or a top dare 34 and a bottom dare 38.

According to one embodiment, a plurality of the playing cards 20 are provided with an "OPT NOT" option 39, as shown in FIG. 3. Players who receive any playing card 20 with the "OPT NOT" option 39 are allowed to skip answering one of the questions posed to them, and instead may require another player to answer the question posed. The playing card 20 with the "OPT NOT" option 39 may be used only once during a game.

To achieve the object of the invention, each one of the top call numerals 32 and bottom call numerals 36 match one of the numeral indicias 31 on the playing cards 20.

According to the preferred embodiment, each deck 10 has a total of thirty-two playing cards 20. Thirty of the playing cards 20 are provided with a numeral indicia 31, and two of the playing cards 20 are provided with the "OPT NOT" option 39.

The truth or dare game starts after the playing cards 20 in the deck 10 have been dealt. The player having the playing card 20 with the lowest numeral indicia 31 asks the first question or dare. For example, if the player's playing card 20 with the lowest numeral indicia 31 comprises a top question 33 and a bottom question 37, then the player may either ask the top question 33 or the bottom question 37 on his playing card 20. As another illustration, if the player's playing card 20 with the lowest numeral indicia 31 comprises a top dare 34 and a bottom question 37, then the player may either ask the top dare 34 or the bottom question 37 on his playing card 20.

The player who has the playing card 20 with the numeral indicia 31 that matches the call numeral adjacent to the question or dare being asked must respond. There are no correct or incorrect answers to any of the questions 33.

Once the question has been answered or the dare complied with, the player who responded asks a question or dare from his playing card 20. As before, the player who has the playing card 20 with the numeral indicia 31 matching the question or dare being asked must respond. Once a player has asked all the questions or dares from his playing card 20, the playing card 20 is discarded into a center pile. This game continues as long as the players wish to play or until all the questions have been used up.

Players who are dealt the playing cards 20 with the OPT NOT option 39 can use them to skip answering a question. Once the question has been responded to by another player, the game continues with the player who used the "OPT NOT" playing card 20 asking a question from his playing cards 20.

Figure 4:
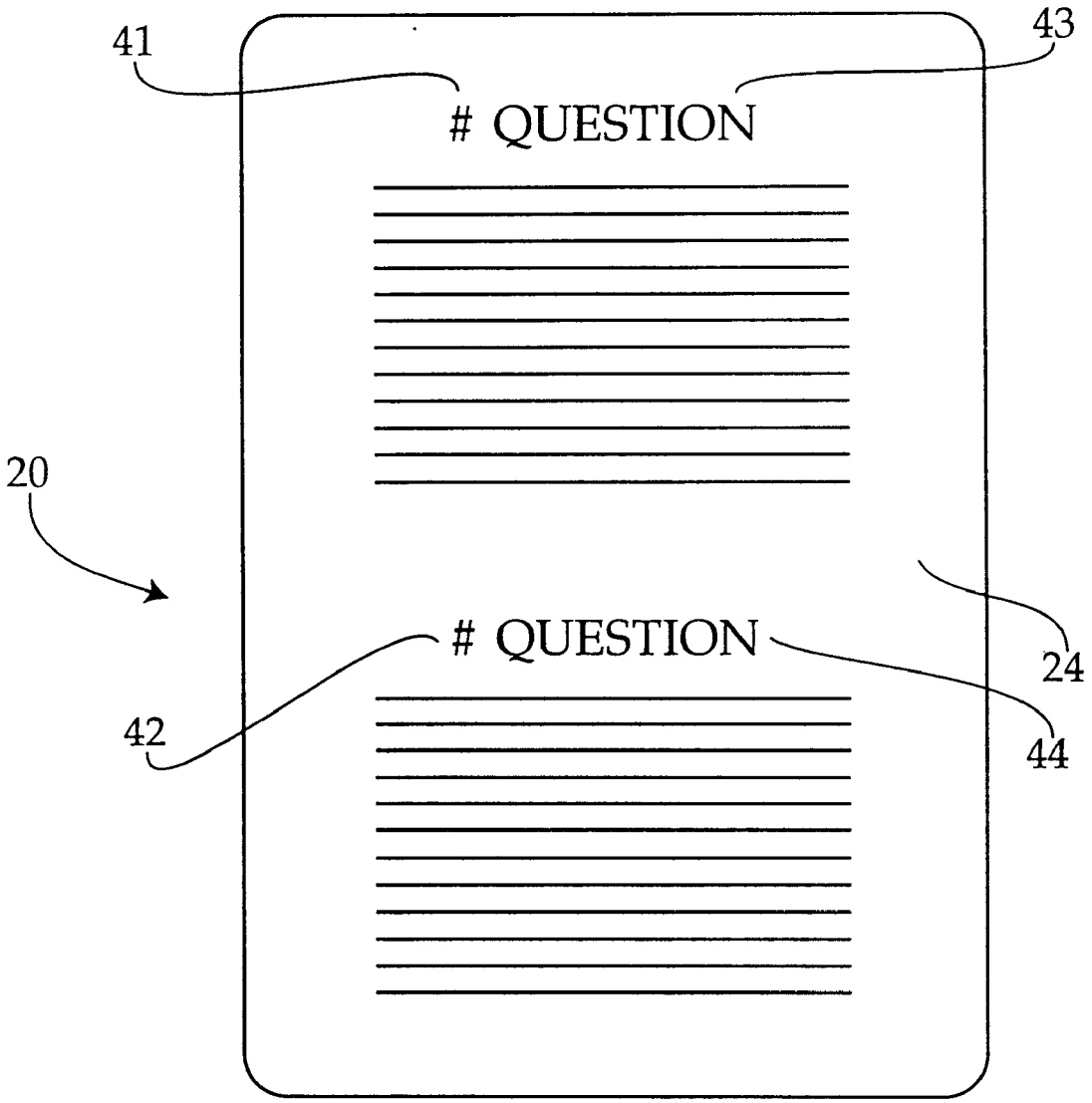
FIG. 4 is a bottom plan view of the playing card according to an alternate embodiment of the present invention.

According to another embodiment of the present invention, shown in FIG. 4, the deck 10 may be provided with playing cards 20 that have trivia questions on the rear side 24. Each playing card 20 is provided with a top question 43 and a bottom question 44. The top questions 43 and bottom questions 44 may pertain to any given subject, such as geography, current affairs, history, literature, etc. An answer is provided below each of the top questions 43 and bottom questions 44.

As shown in FIG. 3, a top call numeral 41 is provided adjacent to the top question 43 and a bottom call numeral 42 is provided adjacent to the bottom question 44.

The game starts when all the playing cards 20 have been dealt. The player having the playing card 20 with the lowest numeral indicia 31 asks the top question 43 or the bottom question 44 on his playing card 20. The player who has the playing card 20 with the numeral indicia 31 that matches the top call numeral 41 or the bottom call number 42 adjacent to the top question 43 or the bottom question 44 must answer.

Once the first question has been answered, the player who responded asks the top question 43 or the bottom question 44 from his playing card. As before, the player who has the playing card 20 with the numeral indicia 31 matching the call numeral of the question being asked must respond.

Once a player has asked the top question 41 and the bottom question 42 from his playing card 20, he discards the playing card 20 into a center pile designated for used up playing cards 20.

According to one embodiment, the responding player receives five points for every top question 43 answered correctly, and ten points for every bottom question 44 answered correctly. At the end of the game, the person with the highest number of points earned wins.

The present invention may be provided with a plurality of decks 10 to accommodate more players or to increase the playing time. According to the preferred embodiment, six decks 10 of different colors are provided to set apart each deck 10 from the others.

Many specific details contained in the above description merely illustrate some preferred embodiments and should not be construed as a limitation on the scope of the invention. Many other variations are possible.

We claim:

1. A method of playing truth or dare with a deck of playing cards, wherein the deck has a plurality of playing cards having a front side and a rear side, the front side of each of said playing cards having a unique numeral indicia for identifying said playing card, the back side of each of said playing cards comprising a pair having a combination of questions and dares, adjacent each question and dare is a unique call number, wherein the unique numerical indicia on any one of said playing cards having a matching unique call number on another one of said playing cards, said method comprising the steps of:

(a) dealing the playing cards to a plurality of players;

(b) asking a question or dare from one of the playing cards by one of the plurality of players;

(c) responding to the question by a player dealt the playing card with numeral indicia matching the call numeral adjacent to the question asked;

(d) asking a question or dare from a playing card held by the player who responded in step (c); and (e) repeating steps (c)–(d) until all questions have been asked from the playing cards.

2. The method of claim 1, wherein said deck further comprises a pair of playing cards having a front side and a rear side, said rear side having OPT NOT printed indicia, said method including the additional step of allowing the player dealt the playing card with said OPT NOT printed indicia the option of not answering the question posed and making another player answer said question, said option allowed to the player only once for each playing card with OPT NOT printed indicia.

3. A method of playing trivia with a deck of playing cards, wherein the deck has a plurality of playing cards having a front side and a rear side, the front side having unique numeral indicia for identifying each playing card, the back side of each of said playing cards having a pair of questions, adjacent, said method comprising the steps of (a) dealing the playing cards to a plurality of players;

(b) asking a question from one of the playing cards by one of the plurality of players;

(c) responding to the question by the player dealt the playing card with the numeral indicia matching the call numeral adjacent to the question asked;

(d) asking a question by the player who responded in step (c); and (e) repeating steps (c)–(d) until all questions have been asked from the playing cards.

4. The method of claim 3, further comprising the additional steps of:

awarding the player a set number of points for correctly responding to the question asked in step (b), after step (c); and determining a winning player by tabulating for each player the points awarded to said player, after step (e).

* * * * *